US009399830B2

(12) United States Patent
Vanderjeugt et al.

(10) Patent No.: US 9,399,830 B2
(45) Date of Patent: Jul. 26, 2016

(54) DEVICE FOR DETACHABLY CONNECTING ELEMENTS FOR POSITIONING WARP YARNS ON A WEAVING LOOM

(71) Applicant: NV MICHEL VAN DE WIELE, Kortrijk/Marke (BE)

(72) Inventors: Bram Vanderjeugt, Ieper (BE); Frederik De Medts, Ooigem (BE); Hannes Christiaen, Ghent (BE)

(73) Assignee: NV MICHEL VAN DE WIELE, Kortrijk/Marke (BE)

( * ) Notice: Subject to any disclaimer, the term of this patent is extended or adjusted under 35 U.S.C. 154(b) by 0 days.

(21) Appl. No.: 14/382,330

(22) PCT Filed: Mar. 1, 2013

(86) PCT No.: PCT/IB2013/000395
§ 371 (c)(1),
(2) Date: Sep. 1, 2014

(87) PCT Pub. No.: WO2013/128275
PCT Pub. Date: Sep. 6, 2013

(65) Prior Publication Data

US 2015/0122367 A1 May 7, 2015

(30) Foreign Application Priority Data

Mar. 1, 2012 (BE) ..... 2012/0133

(51) Int. Cl.
*D03C 3/40* (2006.01)
*D03C 3/24* (2006.01)

(52) U.S. Cl.
CPC ..... *D03C 3/40* (2013.01)

(58) Field of Classification Search
CPC ..... D03C 3/40; D03C 3/42; D03C 3/44; D03C 9/0683; D03C 13/00; D03C 1/14; D03C 3/20; D03C 3/24; D03C 9/00; D03C 9/065; Y10T 24/45743; Y10T 403/66; Y10T 403/599; Y10T 403/7015; Y10T 24/3491; Y10T 24/3922; Y10T 24/45089; Y10T 24/45995; Y10T 403/29; Y10T 403/32598; Y10T 403/53; Y10T 403/7073; F16G 11/10; F16G 11/00; F16D 1/02; Y10S 24/53; Y10S 285/913
See application file for complete search history.

(56) References Cited

U.S. PATENT DOCUMENTS 1,414,838 A 5/1922 Street
1,982,183 A * 11/1934 Tarbox ..... 403/331
(Continued)

FOREIGN PATENT DOCUMENTS

EP 0788562 A1 8/1997

OTHER PUBLICATIONS

International Search Report dated Mar. 25, 2014.

*Primary Examiner* — Bobby Muromoto, Jr.
(74) *Attorney, Agent, or Firm* — Symbus Law Group, LLC; Clifford D. Hyra

(57) ABSTRACT

A coupling device for positioning elements for warp yarns, comprising a male coupling part (1) with a head (8) which, when elastically deformed, can be introduced into a female coupling part (11) via a passage (13) and assumes a larger transverse dimension beyond said passage, so that the head is detained there and the coupling parts (1), (11) are coupled. Beyond this passage (13), the female coupling part (11) comprises an axially displaceable uncoupling body (16) with an opening (17), so that the head can be introduced into this opening (17) and be deformed in the process to such an extent that it can be introduced into the passage (13) in order to uncouple the coupling parts.

20 Claims, 7 Drawing Sheets

(56) References Cited

U.S. PATENT DOCUMENTS

| | | | | | |
|---|---|---|---|---|---|
| 3,422,502 | A | * | 1/1969 | McCarthy | 403/325 |
| 3,810,492 | A | * | 5/1974 | Lauritsen | 139/59 |
| 3,885,598 | A | * | 5/1975 | Vogelbacher | 139/89 |
| 3,918,500 | A | * | 11/1975 | Katsumata | 139/59 |
| 4,034,782 | A | * | 7/1977 | Bucher | 139/85 |
| 4,125,135 | A | * | 11/1978 | Ebisch | 139/456 |
| 4,513,789 | A | * | 4/1985 | Bowen et al. | 139/85 |
| 4,733,442 | A | * | 3/1988 | Asai | 24/580.1 |
| 4,770,213 | A | * | 9/1988 | Peter | 139/88 |
| 4,771,812 | A | * | 9/1988 | Yokoi | 139/82 |
| 5,143,477 | A | * | 9/1992 | Kanehira et al. | 403/341 |
| 5,152,324 | A | * | 10/1992 | Froment | 139/82 |
| 5,309,950 | A | * | 5/1994 | Bassi et al. | 139/88 |
| 5,568,827 | A | * | 10/1996 | Debaes et al. | 139/450 |
| 5,636,663 | A | * | 6/1997 | Lacroix | 139/86 |
| 5,671,782 | A | * | 9/1997 | Lemaire et al. | 139/85 |
| 5,791,382 | A | * | 8/1998 | Froment et al. | 139/85 |
| 6,014,989 | A | * | 1/2000 | Tachon et al. | 139/88 |
| 6,186,188 | B1 | * | 2/2001 | Horter et al. | 139/85 |
| 6,318,415 | B1 | * | 11/2001 | Kutzleb et al. | 139/455 |
| 6,880,582 | B2 | * | 4/2005 | Vanderjeugt et al. | 139/88 |
| 7,025,094 | B2 | * | 4/2006 | Vanderjeugt et al. | 139/59 |
| 7,089,967 | B2 | * | 8/2006 | Debaes | 139/37 |
| 7,117,897 | B2 | * | 10/2006 | Debaes | 139/21 |
| 7,168,454 | B2 | * | 1/2007 | Vanderjeugt | 139/55.1 |
| 7,503,352 | B2 | * | 3/2009 | Vanderjeugt et al. | 139/448 |
| 2003/0221737 | A1 | * | 12/2003 | Vanderjeugt et al. | 139/88 |
| 2004/0159361 | A1 | * | 8/2004 | Vanderjeugt | 139/91 |

* cited by examiner

DEVICE FOR DETACHABLY CONNECTING ELEMENTS FOR POSITIONING WARP YARNS ON A WEAVING LOOM

This application claims the benefit of Belgian patent applications No. BE-2012/0133, filed Mar. 1, 2012, which is hereby incorporated by reference in its entirety.

FIELD OF THE INVENTION

The present invention relates to a device for detachably connecting elements for positioning warp yarns on a weaving loom, comprising a male coupling part which comprises a head, and a female coupling part comprising detaining means which can be reached via a passage and serve to detain the head.

The present invention also relates to a weaving loom provided with a device for positioning warp yarns, in particular a jacquard machine, comprising a number of first and second elements which are detachably connected to each other by being connected to such a male and female coupling part, respectively, while these coupling parts are connected. In particular, the present invention relates to a weaving loom provided with a jacquard device, the tackle cords and the harness cords of which are detachably connected to each other in this way.

BACKGROUND

In a jacquard weaving loom, warp yarns are passed through the eye of a heddle. The jacquard device is designed to move these heddles up and down in order to position the warp yarns with respect to one or more levels at which a well thread is in each case introduced during successive operating cycles.

To this end, a known jacquard device comprises a series of hooks which can be selected to optionally move concomitantly with knives moving up and down in counterphase. The hooks are connected to a tackle system which comprises tackle cords which are connected to the heddles by means of one or more harness cords. At the bottom, the heddles are connected to a spring frame or spring box using retracting springs, so that a downwardly directed spring force is exerted on the heddles, and thus via the harness cords and the tackle cords also on the hooks. When a hook is caught by a reciprocating knife, this downward spring force ensures good contact and reliable hooking onto the moving knife by the hook. The abovementioned components form part of the device with which the warp yarns are positioned on the weaving loom during weaving and are referred to in the present patent application as 'elements (of a device) for positioning warp yarns on a weaving loom', or 'positioning elements' for short.

Each heddle is connected to a harness cord. This connection is achieved by providing a securing element to the end of the heddle. Said securing element, such as e.g. an eye, a resilient fold-back or a clamping element, allows the harness cord to be clamped in the securing element or the harness cord to be turned around the securing element and the returning end part of the harness cord to be connected to the part of the harness cord running towards the securing element, thus forming an eye in the harness cord.

These connections are usually made during the levelling of the eyes of the heddles. During levelling, the connection between each heddle and the harness cord is positioned in such a way that the heddle eye is in a well-defined position with respect to the one or more introduction levels for the weft threads. In order to be able to position the warp yarns extending through the heddle eyes at the correct height in the successive operating cycles, so that successful shed formation across the entire woven fabric is made possible, the heddle eyes obviously also have to be connected to the harness cords at a correct height. In this case, usually all the heddle eyes are connected to their respective harness cords at the same well-defined height.

A harness of a weaving loom sometimes contains thousands of harness cords. The replacement of a harness, for example due to wear of the harness cords or in order to change the configuration of the harness, is a labour-intensive task which involves significant labour costs and which, in addition, also requires long down time of the weaving looms resulting in a corresponding loss in productivity. It is therefore desirable to facilitate these operations by providing constructionally simple connecting means which are easy to handle and make it possible to quickly produce a correct and reliable connection of positioning elements for the warp yarns of a weaving loom.

A number of different types of connecting means have already been developed to provide a quick connection of elements of a jacquard device. EP 0788 562 discloses a connecting device for connecting a harness cord to a tackle cord. This device comprises a first connecting means with an elongate insertion part which ends in a radially widening head, and a second connecting means which comprises a pair of cooperating resilient clamping fingers which are designed to be pushed apart by the head of the first connecting means and to spring back once the head has moved past the clamping fingers. This head is detained in the axial direction by the sprung-back fingers, so that the connecting means are coupled. In order to uncouple the connecting means, the clamping fingers first have to be pushed apart by means of a displaceable part, so that the head is no longer clamped in between the clamping fingers and can be pulled out of the second connecting means.

A drawback of these connecting means is the fact that good coupling of these connecting means depends on two elastically deformable projecting clamping fingers. Such elements are more susceptible to damage, and also have a greater impact on adjacent coupling elements or cords.

SUMMARY

It is an object of the present invention to provide a device for detachably connecting elements for positioning warp yarns on a weaving loom, the components of which are less susceptible to damage so that the device, on average, has a longer service life. An additional object is to provide a connecting device with simple connecting means which are easy to handle and by means of which a reliable connection can quickly be produced, and which makes automation of the connection, individually and/or in a group, possible.

According to the present invention, these objects are achieved by providing a device for detachably connecting elements for positioning warp yarns on a weaving loom, comprising a male coupling part which comprises a head, and a female coupling part comprising detaining means which can be reached via a passage and serve to detain the head, in which, according to the present invention,

- the head is elastically deformable so that the radial dimension thereof is reduced,
- the passage is designed to allow the head through in the deformed state on account of a coupling force,
- beyond the passage, the head returns to a state with a larger transverse dimension so that the head is detained there and the coupling parts are coupled, beyond the passage, the female coupling part comprises an uncoupling body with an opening which is substantially displaceable in the axial direction, the head situated beyond the passage can be displaced into said opening, and the opening is designed to then deform the head in such a manner that it can be introduced into the passage in order to uncouple the coupling parts.

In other words, the female coupling part comprises a passage which only allows the head to pass through in a deformed state and, provided beyond this passage, an uncoupling body which is axially displaceable substantially according to the longitudinal direction of the female coupling part and which has an opening for deforming the head to a smaller radial dimension which allows the head to be inserted into the passage and to remove it from the female coupling part via this passage.

Such a connecting device makes it possible to produce a connection in a quick and simple manner. The coupling parts can be designed in such a manner that they can be coupled by moving the coupling parts according to a mainly rectilinear path towards and into each other.

The uncoupling of the coupling parts can also be effected in a very simple way:

by moving the male coupling part further into the female coupling part, until the head situated beyond the passage reaches the opening of the uncoupling body and is deformed in this opening to a smaller transverse dimension, and by subsequently removing the male coupling part in the opposite direction, away from the female coupling part, in which, in a first stage of the removing movement, the uncoupling body is initially moved along with the male coupling part until a part of the deformed head is situated in the passage or until the deformed head is situated opposite this passage, just before or at the location of this passage, in which the head, in a second stage of the removing movement, is pulled from the opening in the uncoupling body in the deformed state into the passage, while the uncoupling body remains behind, and in which the head, in a third and last stage of the removing movement, is pulled through the passage until it has left the passage and the coupling parts have been taken apart.

The coupling parts can thus also be designed in such a manner that the uncoupling only requires simple rectilinear movements by the coupling elements with respect to each other, so that uncoupling can also be effected quickly. Such coupling parts are thus very user-friendly and easy to handle. The simple coupling and uncoupling also makes these connecting means very suitable for automating the connection of several positioning elements on a weaving loom. The deformable head can also be of a very simple and compact design as a single-part or multi-part deformable element without protruding parts.

The female coupling part can also be designed to be simple, as a hollow element with a passage which only allows the head through in a deformed state, so that the head can assume a larger transverse dimension beyond the passage, and an uncoupling body which is provided beyond this passage and is displaceable in a substantially axial direction.

The present invention is not limited to a device for connecting two or more of the abovementioned positioning elements (hooks, harness cords, tackle cords, spring frame, . . . ), but it goes without saying that other elements of a device for positioning warp yarns on a weaving loom can also be connected in an equally advantageous manner with such a connecting device.

In a particularly advantageous embodiment, the coupling parts are designed to be coupled and uncoupled under the effect of a substantially axial coupling force and uncoupling force. As a result thereof, the coupling parts only have to be moved with respect to each other along the axis of the coupling parts, which is advantageous with regard to the speed of the coupling and uncoupling and ensures a large degree of ease of use.

Preferably, for uncoupling, the head which is situated beyond the passage can be brought into the opening of the uncoupling body by means of an axial displacement in the direction of the female coupling part. Thus, this movement is also a simple movement in the same direction as during coupling of the coupling parts.

In a preferred embodiment, the head and/or the passage are formed in such a way that the head, from a non-deformed state, is deformed starting with the front end against the inlet side of the passage under the effect of a coupling force directed towards the passage and is pushed into the passage. As a result thereof, the deformation of the head takes place automatically on account of the coupling force which is being exerted. This measure also increases the speed and the ease of use during coupling and uncoupling of the coupling parts.

The deformable head may, for example, be designed in such a manner that it has a shape, in at least one lateral projection, which tapers towards the front end. The head preferably has a transverse dimension which gradually decreases towards the front end and, for example, has the shape of a harpoon tip or a conical or frustoconical shape.

The shape of the head in the non-deformed state is also determined in such a manner that it can be efficiently detained beyond the passage of the female part. This shape can be very simple. To this end, the head comprises a detaining surface, for example at the rear end, which is designed to, under the effect of a force which is exerted on the coupling parts and which acts counter to said coupling force, knock against a detaining element of the female part in order to detain the head beyond the passage. The detaining element described here may consist of an edge or an edge portion of the passage or any component or protrusion which prevents further displacement of the head towards the passage.

In the present patent application, the terms coupling force and uncoupling force are only used to indicate which forces are used during the coupling and uncoupling of the coupling parts, and not to indicate the direction of the forces acting on the coupling parts. Under normal conditions of use of the coupled coupling parts, these are pulled away from each other.

A very efficient detaining surface is achieved if, in a longitudinal section of the male coupling part, said detaining surface extends virtually at right angles to the axis of the coupling part or moves away from this axis, extending obliquely towards the rear.

If a rearwardly directed pulling force is exerted on the head, as is most often the case during the functioning of the device for positioning warp yarns on a weaving loom, for example as a result of the retracting springs described above, the head will strike against the detaining element with the perpendicularly or obliquely rearwardly directed detaining surface, as a result of which it will no longer be possible to pull the head into the passage. Thus, a reliable coupling is produced using very simple means.

The uncoupling body is preferably displaceable in the axial direction between a first position in which there is sufficient intermediate space for the head between the uncoupling body and the end of the passage, and a second position in which the coupling body is situated sufficiently close to the end of the passage so that the head in the deformed state can be pulled from the opening of the coupling body into the passage.

In the normal state of use, the uncoupling body will be in the first position due to the force of gravity, but the uncoupling body may be situated too close to the end of the passage during coupling due to accumulation of dust or variations in shape or size. In this case, it is pushed along by the head in the direction of the first position.

In a preferred embodiment, said first and second position are determined by a first and a second stop which determine the extreme positions of the movement trajectory of the uncoupling body.

During uncoupling, the male coupling part is initially pushed along until the head is situated in the opening of the uncoupling body which is placed in the first position. The first stop stops the uncoupling body, so that the head can easily be pushed into the opening. Subsequently, the male coupling part is pulled back, with the head remaining in the opening and the uncoupling body being carried along to the second position. In this second position, the uncoupling body has to be sufficiently close to the end of the passage to pull the head from the opening of the uncoupling body into the passage in the deformed state. This position is determined exactly by the second stop.

If the uncoupling body is situated too closely to the end of the passage during coupling, resulting in insufficient intermediate space for the head, the head has to be able to push the uncoupling body further into the direction of the abovementioned first position. However, during this displacement, the head cannot be pushed into the opening of the uncoupling body, as this would cause a deformation of the head, as a result of which the head could be returned to the deformed state in the passage under the effect of a pulling force, resulting in an undesirable uncoupling.

In addition, undesired uncoupling of the coupling parts as a result from being pushed too far towards each other during coupling has to be prevented. After all, the head can thus already end up in the opening of the uncoupling body during coupling and can then be returned into the passage in the deformed state under the effect of a pulling force.

In a preferred embodiment, a radially compressible protuberance which locally increases the transverse dimension of the head may be provided on the head in order to remedy this. Said protuberance preferably extends substantially at right angles to the direction of the axis of the male coupling part.

Furthermore, said protuberance is preferably connected to the head at a location which is virtually not affected by the deformation of the head during the introduction into the passage, so that this protuberance can also perform its function in the compressed state of the head. Preferably, the protuberance is connected to a part of the head which is virtually not deformed by the introduction of the head into the passage. In a more preferred embodiment, the protuberance is connected to a solid part of the head.

If the head is pushed against the uncoupling body in order to displace it, the pushing force will be transferred to the uncoupling body by the protuberance and the head will be prevented from being pushed into the opening of the uncoupling body. Due to the protuberance being directed substantially transversely, it will only have a small effect on the deformability of the head. If the coupling parts are pushed too far towards each other during the coupling, the protuberance provides an additional resistance, as a result of which the head can be pushed into the opening less easily.

The dimensions of the cross section at the location of the protuberance are preferably such that they can ensure a simple coupling via the passage. In addition, the diameter of the uncoupling body will preferably be slightly smaller than that of the passage in the female coupling part. As a result thereof, the protuberance has virtually no influence on the required coupling force, but is sufficiently large to push the uncoupling body sufficiently far from the end of the passage to prevent the head from undesirably ending up in the uncoupling body during coupling, which would result in an undesired uncoupling, as explained above.

In another embodiment, the female coupling part comprises a receiving space which is situated beyond the passage and in which the uncoupling body is provided in a displaceable manner.

At the end furthest removed from the passage, the receiving space is preferably delimited by an end face which is designed to prevent further movement of the uncoupling body and thus forms the said first stop for the uncoupling body. This end face is preferably also provided with a cavity of such transverse dimensions that an end part of the head extending through the opening of the uncoupling body can be placed into said cavity, while the uncoupling body is detained by the end face.

The length of the head and the uncoupling body, the distance between the first and the second position of the uncoupling body, and the distance between said end face of the receiving space and the end face of the cavity (in other words the depth of this cavity) in the female coupling part, in each case according to the direction of the axis of the passage, are preferably chosen such that the head is situated virtually completely in the opening of the uncoupling body when said head has been pushed as far as possible into the female coupling part. Preferably, the head, with its detaining surface, is then situated completely in the opening of the uncoupling body if said head has been pushed as far as possible into the female coupling part during the uncoupling operation, and preferably with some tolerance remaining in terms of the distance between the rear end of the head with respect to the limiting face on the access side of the opening of the uncoupling body, for example a few tenths of a millimeter to some millimeters.

If the length of the head remains the same, a greater depth of said cavity in the female coupling part provides a shorter uncoupling body, and thus also a shorter connecting device. In addition, this increases the amount of material at the location of said end face (the first stop), so that a more rigid embodiment of the female coupling part is possible.

In an alternative embodiment, the head can be chosen such that it is not situated completely in the opening of the uncoupling body with its detaining surface when it has been pushed as far as possible into the female coupling part during the uncoupling operation. By compressing the head at a location which is possibly situated between the detaining surface and the front end of the head, the uncoupling body then ensures that the dimensions of the deformed head in the compressed state at the location of its detaining surface are still smaller than the passage in the female coupling part.

In addition, the abovementioned dimensions are preferably also chosen such that a small tolerance remains between the head and the uncoupling body after the male and the female coupling part have been coupled and the detaining surface of the head, under the effect of the pulling force which is exerted on the connecting device during the positioning of warp yarns, bears against the detaining element of the female coupling part. Preferably, the dimensions are also chosen such that, when the head has been pushed as far as possible into the female coupling part, that part of the male coupling part which is situated in the receiving space and beyond the head is smaller in length than the uncoupling body. As a result thereof, the uncoupling body cannot end up behind the head unintentionally.

In a particular embodiment, the head is formed from at least two elastically deformable parts which are provided next to one another with an intermediate space, while the head can be compressed in the radial direction by pushing said parts towards one another in a deforming way.

As has been mentioned above, the present invention also relates to a weaving loom provided with a device for positioning warp yarns, comprising a number of first and second elements which are detachably connected to each other, in which, according to the present invention, the detachable connections are produced by means of a connecting device according to the present invention, in which, in each case, the first element is attached to the one coupling part and the second element is attached to the other coupling part, and in which the coupling parts are coupled.

This weaving loom preferably comprises a jacquard device, while said first and second elements are tackle cords and harness cords of the jacquard device.

In another embodiment of the present weaving loom, the latter comprises a jacquard device and it is the heddles and harness cords, or the hooks and tackle cords, or the retracting springs and a spring frame of the jacquard device which are detachably connected to each other by means of a connecting device according to the present invention, in which in each case the one element is attached to the one coupling part and the other element is attached to the other coupling part, and in which the coupling parts are coupled.

BRIEF DESCRIPTION OF THE DRAWINGS

In the following description, a preferred embodiment of a connecting device according to the invention is described in detail. The sole purpose of this detailed description is to indicate how the invention can be achieved and to illustrate the operation and the particular features of the invention and, if necessary, to explain them even more clearly. This description can therefore not be regarded as a limitation of the scope of protection for this patent and neither can the area of application of the invention be limited on the basis of this description.

In this description, reference is made to the attached figures, in which.

DETAILED DESCRIPTION OF EMBODIMENTS

Figure 1:
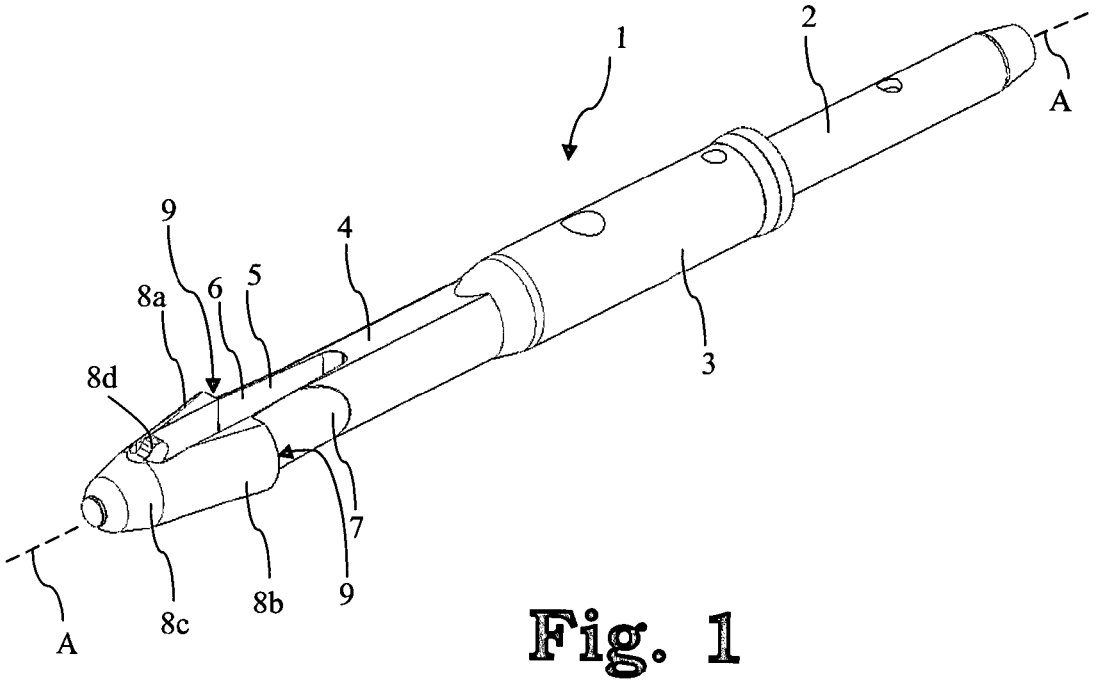
FIG. 1 shows the male coupling part of a connecting device according to the invention in perspective.

The male coupling part (1) (see FIG. 1) comprises an elongate, substantially cylindrical shaft (2,3) which is designed so that tackle cords or harness cords can be attached and which comprises two parts (2), (3) of different diameter. The second part (3) with the largest diameter adjoins a front insertion part (4) having two opposite flattened sides. A crossing recess (5) is provided in the insertion part (4), so that two legs (6), (7) are formed which are separated by the recess. Via a stepped widened section, each leg (6), (7) adjoins a respective head part (8*a*), (8*b*) with two flattened parallel sides and rounded-off lateral flanks which converge symmetrically from the stepped widened section with respect to the axis (A) of the coupling part (1), and adjoin a top part (8*c*). The head parts (8*a*), (8*b*) and the top part (8*c*) together form a head (8) with a rear end which forms a transverse detaining surface (9) due to the stepped widened section. The head (8) has a width which gradually decreases from the rear end to the top.

Figure 2A:
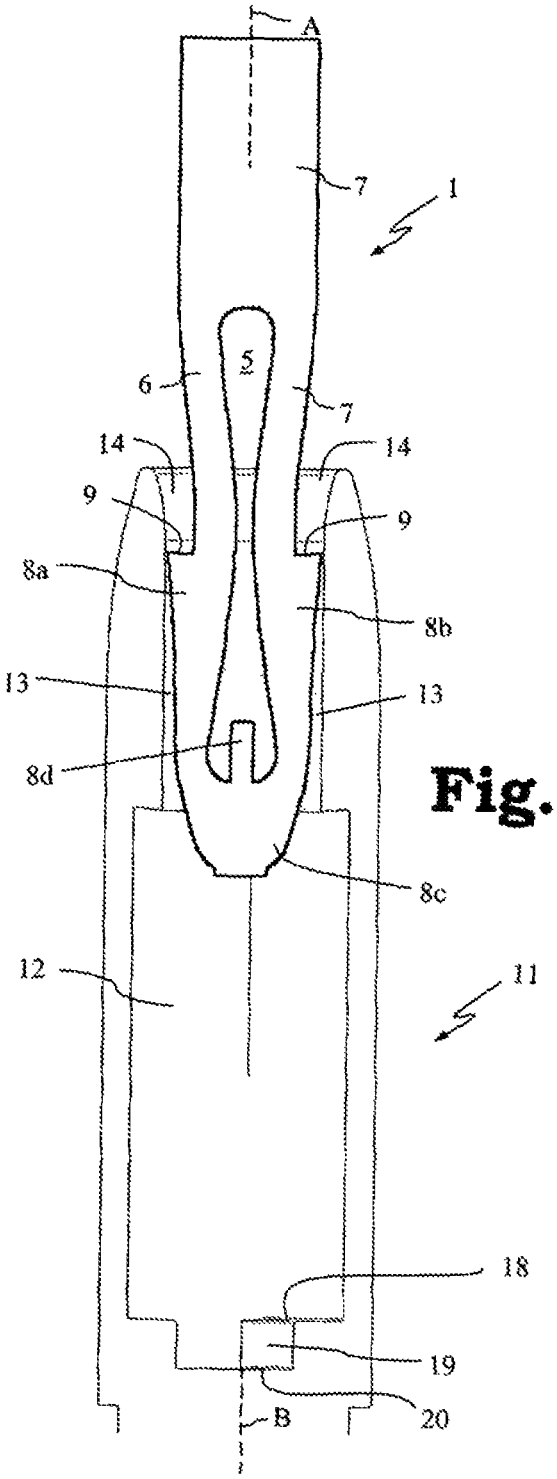
FIGS. 2*a* and 2*b* show a longitudinal section of the coupling parts, during the coupling thereof (FIG. 2*a*) and in a coupled state of these coupling parts (FIG. 2*b*) respectively.
Figure 2B:
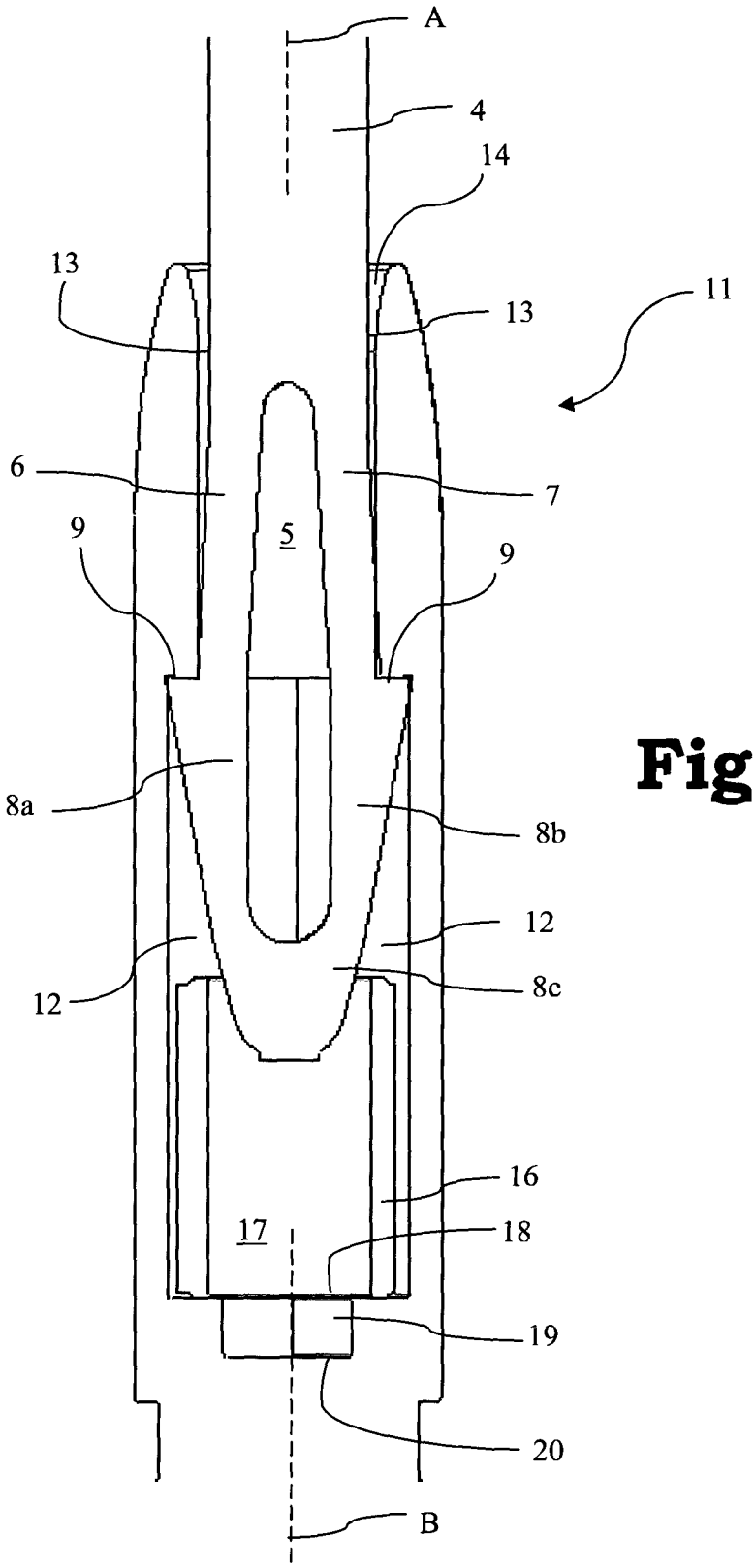

The female coupling part (11) is an elongate element (see in particular FIGS. 2*a*, 2*b* and 3) having a substantially hollow end part in which a receiving space (12) for the head (8) of the male coupling part (1) is provided which is accessible via a passage (13) which is provided from the free end of the female coupling part (11) and ends in the receiving space (12). The passage (13) extends along the longitudinal axis (B) of the coupling part (11) and has a substantially cylindrical shape with a conically narrowing inlet (14) at the end of the coupling part (11).

The edge which is situated around the outlet of the passage (13) in the receiving space (see FIG. 3) serves as a detaining means (15) for the head (8), as will be explained in the remainder of this description.

The receiving space (12) is provided with a cylindrical uncoupling body (16) in which a central opening (17) which is likewise cylindrical is provided. This uncoupling body (16) can be displaced along the longitudinal axis (B) of the coupling part (11) in the receiving space (12), as is illustrated in FIG. 4.

Figure 3:
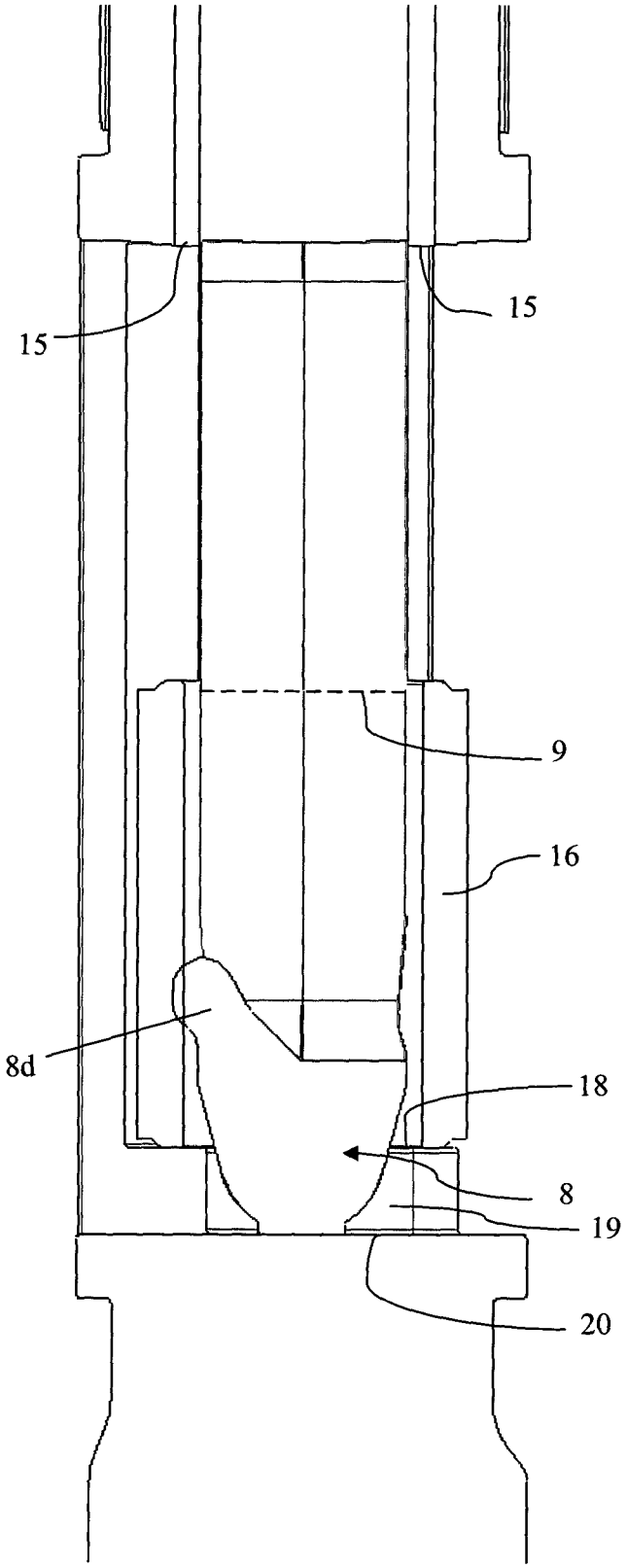
FIG. 3 shows a longitudinal section of these coupling parts during a first step of the uncoupling thereof.
Figure 4:
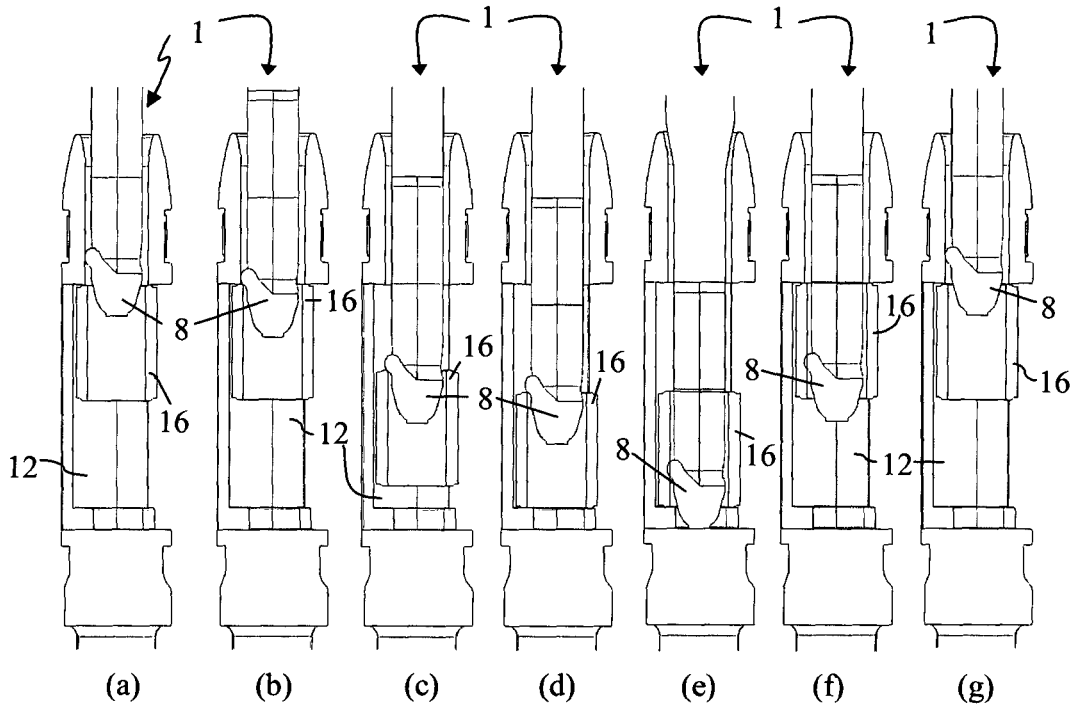
FIGS. 4*a* to 4*g* show these coupling parts in longitudinal section during a number of successive steps during the coupling and uncoupling thereof.

At the head (8), a laterally protruding protuberance (8*d*) is provided on one of the head parts (8*a*), (8*b*) (see FIGS. 1, 3 and 4). The function and the effect of this protuberance will be explained in more detail in the remainder of the description with reference to FIGS. 4*a* to 4*h*. FIGS. 4*a* to 4*g* show four successive stages during coupling of the coupling parts (1), (11). During coupling, the male coupling part (1) is introduced, head (8) first, into the passage (13) of the female coupling part (11) via the conical narrowing (14). In this case, the head (8) is deformed elastically (see FIGS. 2*a* and 4*a*). The male coupling part (1) is pushed further into this passage (see FIG. 4*b*) until the head has reached the receiving space (12) (see FIG. 4*c*). In the receiving space (12), the head (8) assumes a larger transverse dimension.

When the male (1) and the female coupling part (11) are being moved closer together, the radially protruding protuberance (8*d*) of the head (8) comes into contact with the uncoupling body (16). In case this uncoupling body (16) is not situated completely at the bottom in the receiving space (12) (as illustrated in FIGS. 4*a* and 4*b*), said protuberance (8*d*) ensures that the head (8) does not immediately slide into the cylindrical opening (17) of the uncoupling body (16) and is compressed, but a further displacement of the head (8) in the receiving space (12) results, firstly, in that the uncoupling body (16) is moved concomitantly into the vicinity of its end position against the bottom end face (18) of the receiving space (12), as is illustrated in FIGS. 4*c* and 4*d*. In this state, the coupling parts (1), (11) are coupled and if a load were to pull both coupling parts away from each other, this would result in the male coupling part (1) being displaced with respect to the female coupling part (11) until the rear detaining surface (9)

of the head (8) knocks against the edge (15) which is situated around the outlet of the passage (13) and serves as a detaining surface. The male coupling part (1) is thus detained in the receiving space (12) of the female coupling part, thus securing the coupling.

In order to uncouple the coupling parts (1), (11) again, the male coupling part (1) is taken to the position in FIG. 4*d* and then pushed further until the head (8) is pushed into the cylindrical opening (17) of the uncoupling body (16), and the front part of the head (8) is situated in the cavity (19) which is provided in the bottom end face (18) of the receiving space (12). In this case, the head (8) is pushed completely into the cylindrical opening (17) of the uncoupling body (16), so that the head (8) is compressed in the transverse direction. This situation is illustrated in FIG. 4*e*. In this situation, the detaining surface (9) of the head (8) is situated in the vicinity of and preferably just beyond the top edge of the uncoupling body (16). This can be seen more clearly in FIG. 3, which shows the situation from FIG. 4*e* more clearly.

To this end, the protuberance (8*d*) was deformed, and the rebound force of this protuberance (8*d*) and the associated friction force against the uncoupling body (16), ensures that when a force is applied in a direction opposite to the insertion direction of the male coupling part, the uncoupling body (16) moves concomitantly until it reaches a position in which it bears against the edge of the female coupling part (11) which serves as detaining means (15) for the head (8). This situation is illustrated in FIG. 4*f*. Now, the male coupling part (1) can be pulled out of the female coupling part (11) without any problems (see FIG. 4*g*) as the head (8) can be pulled, in the compressed state, from the opening (17) of the uncoupling body (16) into the passage (13) of the female coupling part (11).

At the location of the protuberance (8*d*), the dimensions of the cross section are such that they can ensure simple coupling and uncoupling via the passage (13). In addition, the diameter of the uncoupling body (16) will to this end preferably be slightly smaller than that of the passage (13) in the female coupling part (11). As a result thereof, the protuberance (8*d*) has no effect on the required coupling force, but it still sufficient to push the uncoupling body (16) sufficiently far away from the end of the passage (13), so that the head (8) does not unintentionally enter the uncoupling body (16) during the coupling and is thus immediately uncoupled.

The dimensions of the various parts: length of the head, the distance between first and second position of the uncoupling body (16), the length of the uncoupling body (16), the distance between the end face (18) of the receiving space (12) and the end face (20) of the cavity (19), being the depth of the cavity (19) in the female coupling part (11), are preferably chosen such that the head (8) is situated completely in the uncoupling body (16) when the head (8) has been pushed as far as possible into the female coupling part (11) during the uncoupling operation, with some tolerance regarding the distance between the rear end of the head with respect to the limiting surface at the access side of the opening of the uncoupling body, for example a few tenths of a millimeter to some millimeters, e.g. 0.5 mm, 1, 2, 3 or 4 mm.

In addition, the dimensions are determined such that the head (8), in the coupled state of the coupling parts (1), (11), in which the detaining surface (9) of the head (8) bears against the detaining means (15) of the female coupling part (11) under the effect of a pulling force applied to the connection, is situated at a small distance from the uncoupling body (16), and therefore has a slight tolerance before the head (8) comes into contact with the uncoupling body (12). This distance may be a few tenths of a millimeter to some millimeters, e.g. 0.5 mm, 1, 2, 3 or 4 mm.

Finally, the length of the free space behind the head (8) of the male coupling part (1) is smaller than the length of the uncoupling body (16) when said coupling part (1) has been pushed as far as possible into the female coupling part (11). As a result thereof, the uncoupling body (16) is prevented from unintentionally ending up in this free space behind the head (8).

Typical dimensions for a number of parts are as follows;

Uncoupling body (16):
- length: 3 mm to 10 mm, ideally approximately 5.5 mm;
- internal diameter: 2 mm to 5 mm, ideally approximately 2.7 mm.

Head (8):
- length: 5 mm to 15 mm, ideally approximately 7 mm.

Female coupling part (11):
- diameter of the passage (13): 2.75 mm to 6 mm;
- maximum diameter without protruding parts: 4 mm to 8 mm.

The coupled coupling parts (1), (11) together:
- total length: 60 mm to 120 mm, ideally approximately 75 mm.

The male coupling part (1) is in each case connected to a tackle cord, being a cord which exits the shed-forming mechanism; in an advantageous embodiment according to the invention, the male coupling part (1) is moulded onto the tackle cord by means of an injection-moulding technique used with plastics.

The female coupling part (11) is connected, for example, to a harness cord. In order to weave fabrics in which the pattern or the weaving pattern is repeated several times across the width of the fabric, it is advantageous to connect several harness cords together to the same tackle cord. It is then possible to connect several harness cords to the female coupling part (11) of the connecting device according to the present invention.

Figure 5:
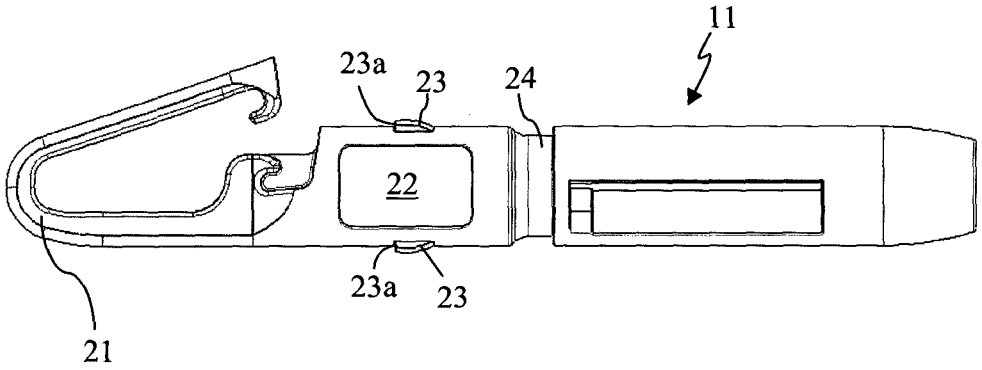
FIG. 5 shows a side view of a female coupling part without coupling body of a variant embodiment of the connecting device according to the present invention.

These harness cords may be connected to the female coupling part (11) in different ways. They are, for example, moulded on, in which case several cords together may be moulded on, or these harness cords are attached to a hook-shaped end part (21) of the female coupling part (see FIG. 5). The tackle cords can also be connected to an intermediate element which is subsequently attached to the female coupling part (11).

Figure 6:
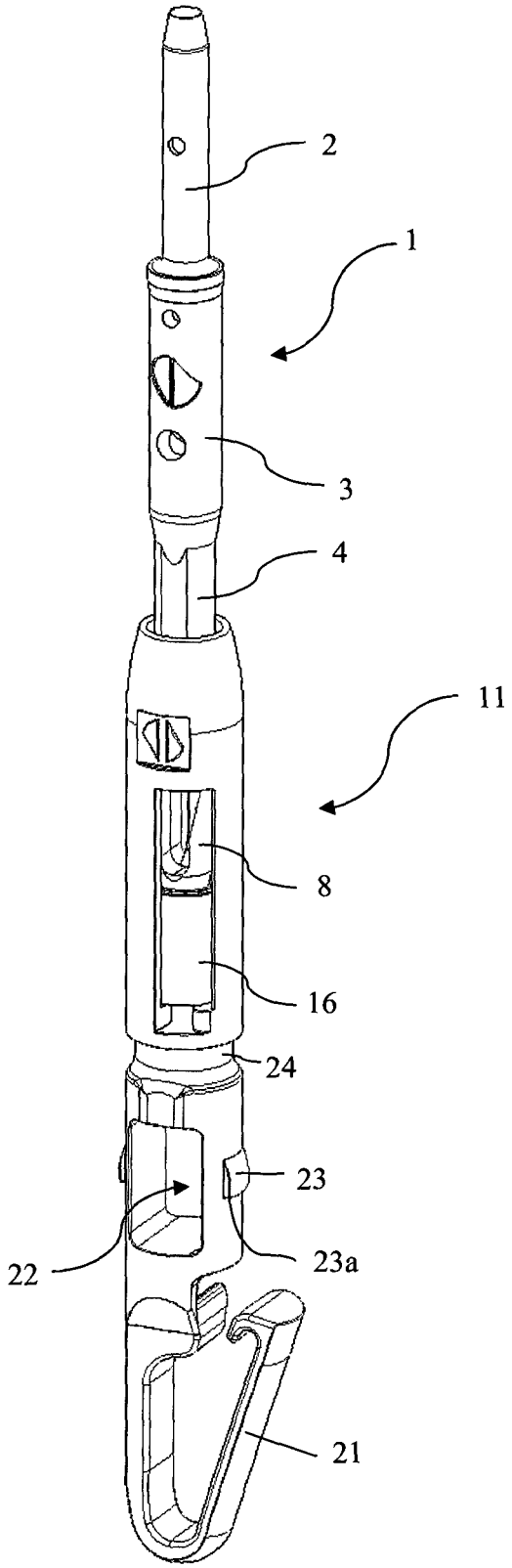
FIG. 6 shows a coupled male and female coupling part of a variant embodiment of the connecting device according to the present invention in perspective.

An opening (22) may also be provided in the female coupling part (see FIG. 6) for the fitting of replacement cords. If one or more harness cords are due to be replaced, for example if they are broken or worn, said opening (22) can be used to attach the new cords to be provided. This is particularly interesting with the variant in which the harness cords were originally moulded onto the female coupling part (11).

The same opening (22) can also be designed to render a part of the female coupling part (11) elastically resilient. This facilitates the coupling to the male coupling part (1).

The female coupling part (11) can then, optionally already connected to the harness cords, be placed in one of the openings in the base board of the jacquard device. This simplifies coupling as a result of the exact positioning of the female coupling part, so that it is also possible to make several coupling connections simultaneously.

Due to the resilient action, it is in addition also possible to offer some resistance, so that the female coupling part (11) cannot readily fall out of or be pulled out of the base board opening by the force exerted by the retracting springs on the other end of the harness cord.

Additional projections (23) in the zone around the additional opening (22) further increase this resistance. These projections (23) are provided on an external wall of the coupling part (11) at the location of the opening (22) and are provided, on the side facing the male coupling part (1), with a gradual transition from said external wall with a radial dimension which, in a first part, intially gradually increases in the direction of the free end of the coupling part (11), where the connection is provided with the harness cords, and ends with a substantially stepped transition (23*a*) which adjoins the external wall of the coupling part (11).

The stepped transition (23*a*) forms a barbed part which prevents the coupling part (11) from unintentionally falling out of or being pulled out of the base board opening by the force which the retracting springs exert thereon, for example during the uncoupling of the coupling parts (1), (11).

In addition, the coupling of the coupling parts (1), (11) is also facilitated further thereby, as the position of the female coupling parts (11) is secured even better and more resistance against the forces along the coupling direction can be provided.

A subsequent part of the female coupling part (11) is a handling part (24) which is designed as a local radial constriction of the external wall of the female coupling part (11). This makes it possible for the female coupling part (11) to be gripped by a manipulator which is provided for coupling and/or uncoupling the coupling parts (1), (11).

To this end, the manipulator is for example provided with suitable gripping or holding means to enclose the handling part (24) of the female coupling part (11). The manipulator may form part of a tool or a device which makes coupling and/or uncoupling of several pairs of coupling parts (1), (11) in one movement possible.

Such a device may, for example, be designed to completely or partly automate the coupling and/or uncoupling of the coupling parts according to the present invention.

The invention claimed is:

1. Device for detachably connecting elements for positioning warp yarns on a weaving loom, comprising:

a male coupling part which comprises a head; and a female coupling part comprising a detaining element which is configured to be reached via a passage and serves to detain the head, and beyond the passage, an uncoupling body having an opening, which is substantially displaceable in the axial direction;

wherein the head is elastically deformable so that the radial dimension thereof is reduced, in that the passage is designed to allow the head through in the deformed state on account of a coupling force;

wherein beyond the passage, the head returns to a state with a larger transverse dimension so that the head is detained there and the coupling parts are coupled;

wherein the head situated beyond the passage is configured to be displaced into said opening; and wherein said opening is designed to then deform the head in such a manner that the head is capable of being introduced into the passage in order to uncouple the coupling parts.

2. Device according to claim 1, characterized in that the coupling parts are designed to be coupled and uncoupled under the effect of a substantially axial coupling force and uncoupling force.

3. Device according to claim 1, characterized in that the head which is situated beyond the passage is configured to be brought into the opening of the uncoupling body by means of an axial displacement in the direction of the female coupling part.

4. Device according to claim 1, characterized in that the head and/or the passage are formed in such a way that the head, from a non-deformed state with the front end against the inlet side of the passage, is deformed under the effect of a coupling force directed towards the passage and is pushed into the passage.

5. Device according to claim 1, characterized in that the head has a transverse dimension which gradually decreases towards the front end.

6. Device according to claim 1, characterized in that the rear end of the head comprises a detaining surface which is designed to, under the effect of a force which is exerted on the coupling parts and which acts counter to said coupling force, knock against the detaining element of the female part in order to detain the head beyond the passage.

7. Device according to claim 1, characterized in that, in a longitudinal section, the detaining surface extends at right angles to the axis of the male coupling part or moves away from this axis, extending obliquely towards the rear.

8. Device according to claim 1, characterized in that the uncoupling body is displaceable in the axial direction between a first and a second stop.

9. Device according to claim 1, characterized in that a radially compressible protuberance is provided on a side wall of the head which locally increases the transverse dimension of the head.

10. Device according to claim 9, characterized in that said protuberance extends substantially at right angles to the direction of the axis of the male coupling part.

11. Device according to claim 9, characterized in that said protuberance is connected to a part of the head which is not deformed by the introduction of the head into the passage.

12. Device according to claim 1, characterized in that the female coupling part comprises a receiving space which is situated beyond the passage, and in that the uncoupling body is provided in said receiving space in a displaceable manner.

13. Device according to claim 12, characterized in that, at the end furthest removed from the passage, the receiving space is delimited by an end face which is designed to prevent further movement of the uncoupling body, and in that said end face is provided with a cavity of such transverse dimensions that the end part of the head extending through the opening of the uncoupling body is capable of being placed into said cavity, while the uncoupling body is detained by the end face.

14. Device according to claim 13, characterized in that the length of the head, the length of the uncoupling body, the distance between the first and the second position of the uncoupling body, and the distance between said end face of the receiving space and the end face of the cavity in the female coupling part, are chosen such that the head is situated completely in the opening of the uncoupling body when said head has been pushed as far as possible into the female coupling part.

15. Device according to claim 13, characterized in that said lengths and distances are chosen such that, when the head has been pushed as far as possible into the female coupling part, that part of the head which is situated in the receiving space is smaller in length than the uncoupling body.

16. Device according to claim 1, characterized in that the head is formed from at least two elastically deformable parts which are provided next to one another with an intermediate space, and in that the head can be compressed in the radial direction by pushing said parts towards one another in a deforming way.

17. Weaving loom provided with a device for positioning warp yarns, comprising a number of first and second elements which are detachably connected to each other, wherein the detachable connections are produced by means of a connecting device according to claim 1, in which, in each case, the first element is attached to the one coupling part and the second element is attached to the other coupling part, and in which the coupling parts are coupled.

18. Weaving loom according to claim 17, further comprising a jacquard device and wherein said first and second elements are tackle cords and harness cords of the jacquard device.

19. Weaving loom according to claim 17, further comprising a jacquard device and wherein said first and second elements are heddles and harness cords, or hooks and tackle cords, or retracting springs and a spring frame of the jacquard device.

20. A method of using a device for detachably connecting elements for positioning warp yarns on a weaving loom, the device comprising a male coupling part which comprises a head and a female coupling part which comprises a detaining element which is configured to be reached via a passage and serves to detain the head, and beyond the passage an uncoupling body with an opening which is substantially displaceable in the axial direction, the method comprising:

elastically deforming the head so that the radial dimension thereof is reduced, so that the head can be inserted into the passage;

inserting the head through the passage by a coupling force;

beyond the passage, allowing the head to return to a state with a larger transverse dimension so that the head is detained there and the coupling parts are coupled;

displacing the head situated beyond the passage into the opening in the uncoupling body, thereby deforming the head so that the radial dimension thereof is reduced, so that the head can again be inserted into the passage; and introducing the head back into the passage in order to uncouple the coupling parts.

* * * * *